US005869957A

United States Patent [19]

Koike

[11] Patent Number: 5,869,957

[45] Date of Patent: Feb. 9, 1999

[54] VOLTAGE DIVIDER CIRCUIT, DIFFERENTIAL AMPLIFIER CIRCUIT AND SEMICONDUCTOR INTEGRATED CIRCUIT DEVICE

[75] Inventor: Hideharu Koike, Yokohoma, Japan

[73] Assignee: Kabushiki Kaisha Toshiba, Kawasaki, Japan

[21] Appl. No.: 56,631

[22] Filed: Apr. 8, 1998

[30] Foreign Application Priority Data

Apr. 8, 1997 [JP] Japan ..... 9-089614

[51] Int. Cl.[6] ..... G05F 3/16

[52] U.S. Cl. ..... 323/313; 323/280

[58] Field of Search ..... 323/265, 267, 323/273, 280, 281, 311, 312, 313, 314, 316; 327/530, 537, 538

[56] References Cited

U.S. PATENT DOCUMENTS

| | | | |
|---|---|---|---|
| 3,887,863 | 6/1975 | Brokaw | 323/314 |
| 4,553,098 | 11/1985 | Yoh et al. | 324/433 |
| 4,609,833 | 9/1986 | Guterman | 307/297 |
| 4,636,710 | 1/1987 | Stanojevic | 323/280 |
| 5,068,593 | 11/1991 | Wright | 323/315 |
| 5,159,260 | 10/1992 | Yoh et al. | 323/313 |
| 5,300,877 | 4/1994 | Tesch | 323/313 |
| 5,512,814 | 4/1996 | Allman | 323/267 |
| 5,559,687 | 9/1996 | Nicollini et al. | 363/60 |
| 5,563,501 | 10/1996 | Chan | 323/282 |
| 5,686,821 | 11/1997 | Brokaw | 323/273 |

*Primary Examiner*—Adolf Denske Berhane
*Attorney, Agent, or Firm*—Oblon, Spivak, McClelland, Maier & Neustadt, P.C.

[57] ABSTRACT

A voltage divider circuit comprises first and second transistor pairs 1 and 2 connected in series between a first standard voltage terminal VD and a second standard voltage terminal VS, and feedback control circuit 3. Each of transistor pairs comprises two NMOS transistors with the same electric characteristics, respectively. A divided ratio is set by a voltage applied to the gate terminals of these NMOS transistors M1–M4. Feedback-control circuit 3 comprises a load transistor pair 4 and an operational amplifier OP1. The circuit 3 performs feedback-control so that a voltage of connection lines L1 and L2 which connects first and second pairs of transistors becomes equal. Therefore, a high accurate divided voltage is outputted from between pairs 1 and 2 of transistors.

20 Claims, 7 Drawing Sheets

VOLTAGE DIVIDER CIRCUIT, DIFFERENTIAL AMPLIFIER CIRCUIT AND SEMICONDUCTOR INTEGRATED CIRCUIT DEVICE

BACKGROUND OF THE INVENTION

1. Field of the Invention

The present invention relates to a voltage divider circuit which outputs a voltage between first and second voltages, and a differential amplifier circuit which outputs a voltage converted a voltage level of a differential input voltage. More specifically, the present invention relates to a circuit which can be formed on a semiconductor substrate.

2. Related Background Art

When a plurality of resistors are connected in series, with one end of those resistors being connected to a power supply voltage, and with the other end being grounded, it is possible to produce a divided voltage. Such a circuit is called a divider circuit. The circuit is used for various objects, because the circuit has a simple configuration.

In case of forming a divider circuit on a semiconductor substrate, it is customary to form resistors using poly-silicon. However, it is difficult to form resistors with high resistance using poly-silicon. Further, when the divider circuit is formed by using poly-silicon, it is necessary to change the production process in order to change the divided resistance ratio of the divider circuit. That is, it is not easy to change a voltage level of the divided voltage after the production process had been performed, because it is necessary to change the width and thickness of a poly-silicon layer by revising a photo mask and so on.

On the other hand, it is possible to replace the resistors by MOS transistors. However, even if the resistors are replaced by MOS transistors, it is impossible to obtain high accurate resistance ratio due to distortion of a threshold voltage Vth and so on.

SUMMARY OF THE INVENTION

Accordingly, the object of the present invention is to provide a voltage divider circuit, a differential amplifier circuit and a semiconductor integrated circuit device, which can easily integrate and easily adjust the voltage level of a divided voltage and a differential output voltage.

To achieve the above-mentioned object, the invention provides a voltage divider circuit for outputting a divided voltage between first and second voltages, comprising:

a first voltage terminal with said first voltage;

a second voltage terminal with said second voltage;

a plurality of transistor pairs constructed by two MOS transistors, which have the same electric characteristics, said transistor pairs being connected in series between said first and second voltage terminals;

feedback control circuit for performing feedback-control so that voltages of connection lines which connect said each of transistor pairs arranged in adjacent location become equal, wherein said divided voltage is outputted from between said transistor pairs arranged in adjacent location.

Further, the present invention provides a differential output circuit which outputs a differential voltage depending on the difference between first and second input voltages, comprising:

a first differential amplifier having a differential input terminal to which said first input voltage is applied;

a second differential amplifier having a differential input terminal to which said second input voltage is applied;

a voltage divider circuit having a plurality of transistor pairs, each of which comprises two transistors with the same electric characteristics, which are connected in series between output terminals of said first and second differential amplifiers, wherein:

said voltage divider circuit comprises a feedback control circuit which performs feedback-control so that voltages of connection lines which connect each of said transistor pairs arranged in adjacent location become equal, wherein one of two divided voltages outputted from said voltage divider circuit is applied to the other of the differential input terminals of said second differential amplifier;

the other of the divided voltages is applied to the other of the differential input terminals of said second differential amplifier; and said differential voltage is outputted from said first and second differential amplifiers.

Because the present invention composes a voltage divided circuit by combining with the NMOS transistors, it is unnecessary to provide resistors; therefore, it is easy to integrate the circuit according to the present invention on a semiconductor substrate. In addition, because the NMOS transistors have the same electric characteristics, the circuit according to the present invention is not affected by distortion of the threshold voltage Vth and the production process; therefore, it is possible to output the divided voltage with high accuracy. Further, because it is possible to optionally change the divided ratio by controlling gate voltages of the NMOS transistors, it is possible to output the divided voltage with various voltage levels without changing the production process.

BRIEF DESCRIPTION OF THE DRAWING

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

The present invention can be more fully understood by reference to the following description and accompanying drawing.

(First embodiment)

A first embodiment of the present invention comprises a divider circuit constructed by MOS transistors so that an output of the divider circuit is not affected by distortion of characteristics of MOS transistors.

Figure 1:
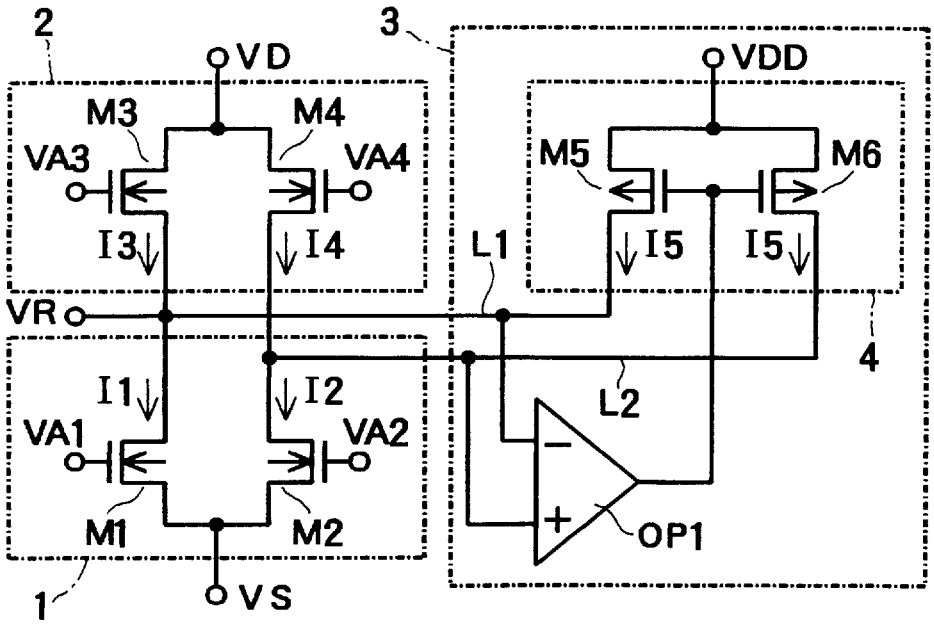
FIG. 1 is a circuit diagram showing the configuration of a voltage divider circuit in a first embodiment of the invention.

FIG. 1 is a circuit diagram showing the detailed configuration of a voltage divider circuit in the first embodiment. The voltage divider circuit in FIG. 1 comprises first and second transistor pairs 1 and 2 connected in series between first standard voltage terminal VD and second standard voltage VS, and feedback control circuit 3.

The first transistor pair 1 is constructed by NMOS transistors M1 and M2 which have the same electric characteristics, and the second transistor pairs 2 is constructed by NMOS transistors M3 and M4 which also have the same electric characteristics. A first differential input voltage (VA1−VA2) is applied to gate terminals of the NMOS transistor M1 and M2, and a second differential input voltage (VA3−VA4) is applied to gate terminals of the NMOS transistor M3 and M4. A divided resistance ratio is set in accordance with a voltage level of these first and second differential input voltages. A divided voltage VR is outputted from between the first and second transistor pairs 1 and 2. In the following, it is assumed that the NMOS transistors M1–M4 operate in an active region.

The feedback control circuit 3 comprises a load transistor pair 4 and an operational amplifier OP1. The circuit 3 performs feedback control so that the voltage of connection lines L1 and L2 between the first and second transistor pairs 1 and 2 become equal. The load transistor pair 4 is constructed by PMOS transistors M5 and M6. In the following, it is assumed that the transistors M5 and M6 operate in a saturated region.

The inverting input terminal of the operational amplifier OP1 is connected to the above mentioned connection line L1, and the non-inverting input terminal of the operational amplifier OP1 is connected to the connection line L2. The output terminal of the operational amplifier OP1 is connected to the gate terminal of the PMOS transistors M5 and M6. The source terminals of the transistors M5 and M6 are connected to the power supply voltage terminal VDD, the drain terminal of the PMOS transistor M5 is connected to the connection line L1, and the drain terminal of the PMOS transistor M6 is connected to the connection line L2.

The following equations (1) and (2) are established, where I1 and I2 are current flowing through the drain and source terminals of NMOS transistors M1 and M2. Kn in equation (1) and (2) is expressed by equation (3), and $\mu$ is mobility, Cox is capacity of a gate oxide layer per a unit area, and W and L are size of NMOS transistors M1 and M2.

$$I1=2Kn*\{VA1-VS-Vthn-(VR-VS)/2\}*(VR-VS) \quad (1)$$

$$I2=2Kn*\{VA2-VS-Vthn-(VR-VS)/2\}*(VR-VS) \quad (2)$$

$$Kn=(\mu Cox/2)*(W/L) \quad (3)$$

Equation (4) is obtained by equations (1), (2).

$$I1-I2=2Kn*(VA1-VA2)*(VR-VS) \quad (4)$$

As shown by equation (4), the difference (I1−I2) of a current flowing through NMOS transistors M1 and M2 is proportional to the product of a current coefficient of each NMOS transistor, the difference of each gate voltage, and the voltage between the drain and source terminals.

On the other hand, because the source voltage of the NMOS transistors M3 and M4 is higher than the source voltage of the NMOS transistors M1 and M2, body effect of the NMOS transistors M3 and M4 becomes larger than that of the NMOS transistors M1 and M2. Accordingly, the threshold voltage Vthn' of the NMOS transistors M3 and M4 becomes higher than that of the NMOS transistors M1 and M2. The source voltages of the NMOS transistors M3 and M4 are controlled so as to become equal to each other by providing the operational amplifier OP1; consequently, the threshold voltages of the NMOS transistors M3 and M4 become equal to each other.

The current flowing through the NMOS transistors M3 and M4 is expressed by equations (5) and (6), and the difference between the equations (5) and (6) is expressed by equation (7), where Vthn' is the threshold voltage of the NMOS transistors M3 and M4, and Kn' is the current coefficient of the NMOS transistors M3 and M4.

$$I3=2Kn'*\{VA3-VR-Vthn'-(VD-VR)/2\}*(VD-VR) \quad (5)$$

$$I4=2Kn'*\{VA4-VR-Vthn'-(VD-VR)/2\}*(VD-VR) \quad (6)$$

$$I3-I4=2Kn'*(VA3-VA4)*(VD-VR) \quad (7)$$

As shown by equation (7), the difference between the currents flowing through the NMOS transistors M3 and M4 is proportional to the product of the current coefficients of NMOS transistor M3 and M4, the difference of the gate voltages, and the voltage between the drain and source terminals.

On the other hand, because the voltage between the gate and source terminals of the PMOS transistors M5, M6 in feedback-control circuit 3 is equal to each other, the current flowing through the drain and source terminals of the PMOS transistors M5, M6 becomes equal. Therefore, equations (8) and (9) is established.

$$I1=I3+I5 \quad (8)$$

$$I2=I4+I6 \quad (9)$$

Equation (10) is obtained by equation (8) and (9).

$$I1-I2=I3-I4 \quad (10)$$

When equations (4) and (7) are substituted for (10), equation (11) is established.

$$2Kn*(VA1-VA2)*(VR-VS)=2Kn'*(VA3-VA4)*(VD-VR) \quad (11)$$

Equation (12) is obtained by transformation of the equation (11).

$$\begin{aligned} VR-VS = {} & 1/\{Kn(VA1-VA2)\}* \\ & [1/\{Kn(VA1-VA2)\}+ \\ & 1/\{Kn'(VA3-VA4)\}]* \\ & (VD-VR) \end{aligned} \quad (12)$$

As shown by equation (12), the divided voltage VR is decided by the current coefficient Kn and Kn', the standard voltage VD and VS, and the first and second differential input voltage (VA1−VA2) and (VA3−VA4), and is independent of the Vthn and Vthn'. That is, the divided voltage VR is not affected by the distortion of the threshold voltage Vthn and Vthn'.

Figure 2:
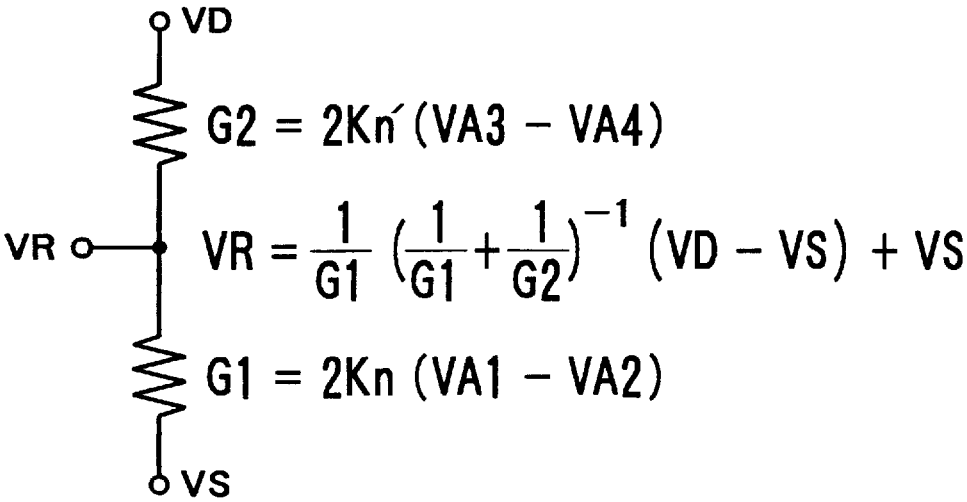
FIG. 2 is an equivalent circuit of FIG. 1.

According to the equation (12), the circuit in FIG. 1 is equivalently expressed by a resistance divider circuit in FIG. 2. In the circuit, the NMOS transistors M1–M4 function as resistors, and FIGS. G1 and G2 in FIG. 2 express a reciprocal of the resistor.

As described above, the first embodiment comprises the divider circuit in which two transistor pairs 1 and 2 are connected in series, and the operational amplifier OP1 performs feedback-control. Therefore, it is possible to output the divided voltage with high accuracy and little fluctuation of voltage.

Further, because it is possible to optionally change the resistance ratio by controlling the gate voltage of the NMOS transistors M1–M4 composing the transistor pairs 1 and 2, it is possible to obtain the divided voltage with various voltage levels as a need arises. Especially, because the divider circuit of the present invention has no resistor inside, it is easy to form the circuit on a semiconductor substrate. Further, because the circuit can adjust the divided ratio by means of the change of the gate voltage after the production process had performed, the circuit is not affected by the distortion of the electric characteristics.

(Second embodiment)

A second embodiment of the present invention comprises a voltage divider circuit in which more than three transistor pairs are connected in series.

Figure 3:
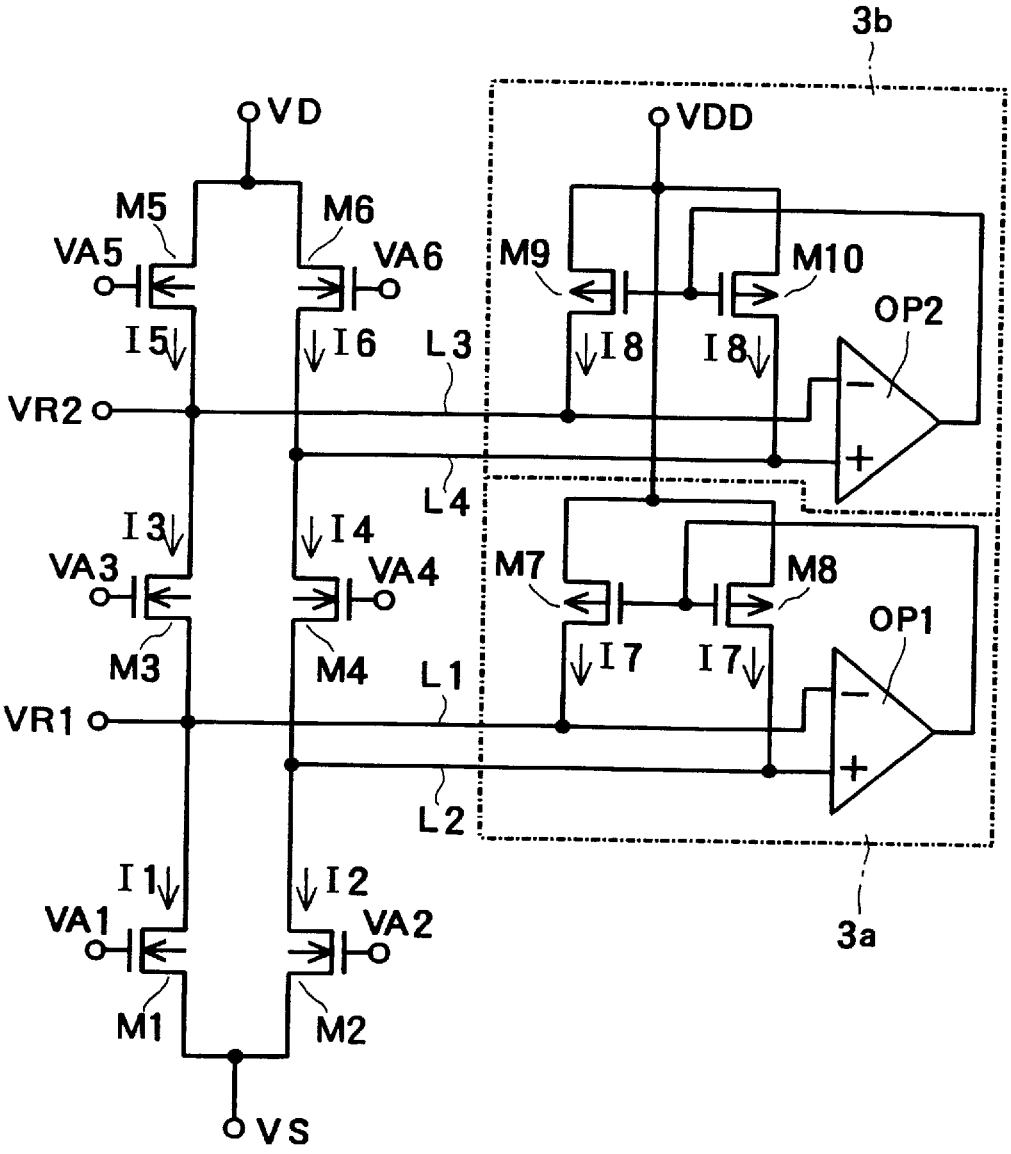
FIG. 3 is a circuit diagram showing the configuration of a voltage divider circuit in a second embodiment.

FIG. 3 is a circuit diagram showing the detailed configuration of a voltage divider circuit in the second embodiment. Three sets of transistor pairs are connected in series between the first standard voltage terminal VD and the second standard voltage terminal VS. The NMOS transistors M1–M6 operate in an active region, and each of voltages VA1–VA6 is applied to the respective gate terminals of the NMOS transistors M1–M6. These gate voltages are set so that VA1>VA2, VA3>VA4, and VA5>VA6 are established. The resistance divided ratio is set in accordance with the difference between the gate voltages of these transistor pairs.

Further, the voltage divider circuit in FIG. 3 comprises a first feedback control circuit 3*a* having an operational amplifier OP1 and load transistor pairs M7 and M8, and a second feedback control circuit 3*b* having an operational amplifier OP2 and load transistor pairs M9 and M10. The first feedback control circuit 3*a* performs feedback-control so that the voltage of the connection line L1 which connects the drain terminal of the NMOS transistor M1 and the source terminal of the NMOS transistor M3 becomes equal to the voltage of the connection line L2 which connects the drain terminal of the NMOS transistor M2 and the source terminal of the NMOS transistor M4. Similarly, the second feedback control circuit 3*b* performs feedback-control so that the voltages of the connection lines L3 and L4 become equal to each other.

In a stable state, the currents I1 and I2 flowing through the drain and source terminals of the NMOS transistors M1 and M2 are expressed by equations (13) and (14), where Kn is the current coefficient of the NMOS transistors M1 and M2, and Vthn is the threshold voltage of the NMOS transistors M1 and M2.

$$I1=2Kn*\{VA1-VS-Vthn-(VR1-VS)/2\}*(VR1-VS) \quad (13)$$

$$I2=2Kn*\{VA2-VS-Vthn-(VR1-VS)/2\}*(VR1-VS) \quad (14)$$

Similarly, in the stable state, the current I3 and I4 flowing through the drain and source terminals of the NMOS transistors M3 and M4 are expressed by equations (15) and (16), where Kn' is the current coefficient of the NMOS transistors M3 and M4, and Vthn' is the threshold voltage of the NMOS transistors M3 and M4.

$$I3 = 2Kn' * \{VA3 - VR1 - Vthn' - (VR2 - VR1)/2\} * (VR2 - VR1) \quad (15)$$

$$I4 = 2Kn' * \{VA4 - VR1 - Vthn' - (VR2 - VR1)/2\} * (VR2 - VR1) \quad (16)$$

Similarly, in the stable state, the current I5 and I6 flowing through the drain and source terminals of the PMOS transistors MS and M6 are expressed by equations (17) and (18), where Kn" is the current coefficient of the PMOS transistors MS and M6, and Vthn" is the threshold voltage of the PMOS transistors MS and M6.

$$I5=2Kn"*\{VA5-VR2-Vthn"-(VD-VR2)/2\}*(VD-VR2) \quad (17)$$

$$I6=2Kn"*\{VA6-VR2-Vthn"-(V1-VR2)/2\}*(VD-VR2) \quad (18)$$

Equation (19) is obtained by the equations (13) and (14).

$$I1-I2=2Kn*(VA1-VA2)*(VR1-VS) \quad (19)$$

Equation (20) is obtained by the equations (15) and (16).

$$I3-I4=2Kn'*(VA3-VA4)*(VR1-VS) \quad (20)$$

Equation (21) is obtained by the equations (17) and (18).

$$I5-I6=2Kn"*(VA5-VA6)*(VR1-VS) \quad (21)$$

The following equations (22) and (23) are established by FIG. 3, and equation (24) is obtained by the equations (22) and (23)

$$I1-I2=(I3+I7)-(I4+I7 \quad (22)$$

$$I3-I4=(I5+I8)-(I6+I8) \quad (23)$$

$$I1-I2=I3-I4=I5-I6 \quad (24)$$

Accordingly, equations (25)–(27) are obtained by equations (19)–(21) and (24).

$$VR1-VS=[1/\{2Kn(VA1-VA2)\}]*\{(VD-VS)/R\} \quad (25)$$

$$VR2-VR1=[1/\{2Kn'(VA3-VA4)\}]*\{(VD-VS)/R\} \quad (26)$$

$$VD-VR2=[1/\{2Kn"(VA5-VA6)\}]*\{(VD-VS)/R\} \quad (27)$$

R in the equations (25)–(27) is expressed by equation (28).

$$R=[1/\{2Kn(VA1-VA2)\}+1/\{2Kn'(VA3-VA4)\}+1/\{2Kn"(VA5-VA6)\}] \quad (28)$$

As can be seen clearly from the equations (25)–(28), the divided voltages VR1 and VR2 have no relation to the threshold voltages Vthn, Vthn' and Vthn". Accordingly, the divided voltage VR1 and VR2 are not affected by the distortion of the characteristics of the NMOS transistors M1–M6.

Figure 4:
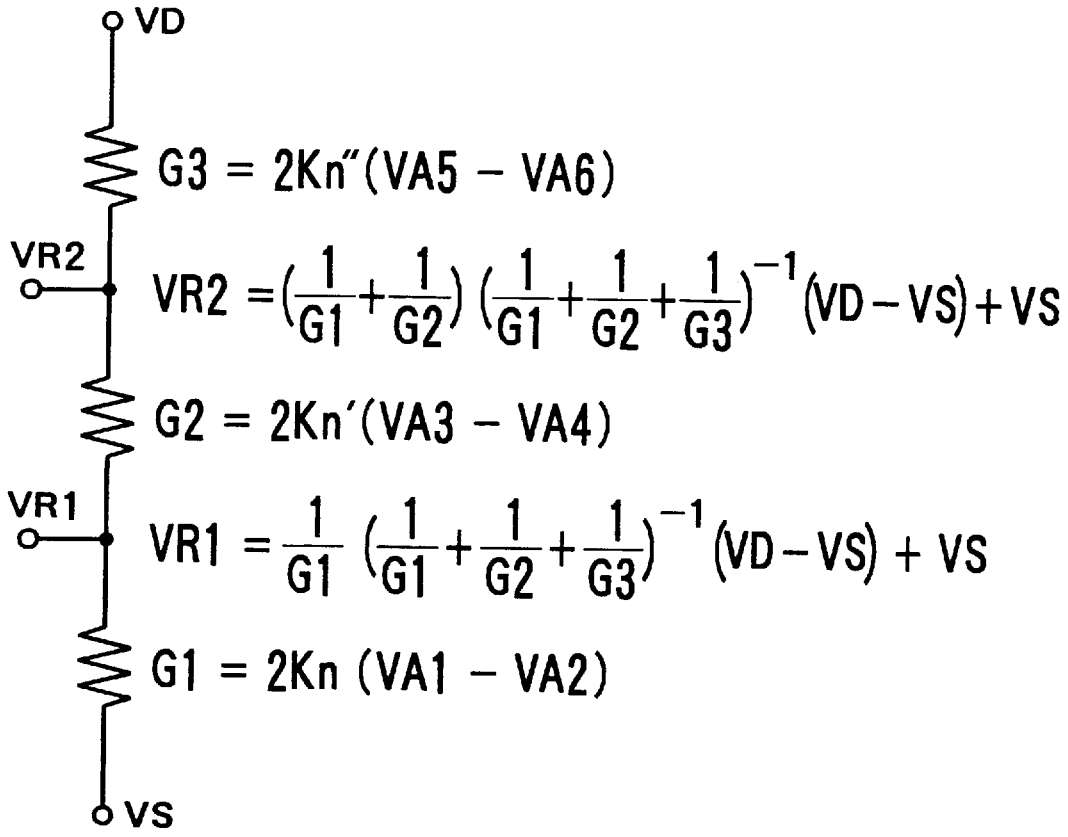
FIG. 4 is an equivalent circuit of FIG. 3.

As can be seen clearly from the equations (25)–(27) the circuit in FIG. 3 is substantially equal to a resistor divider circuit in FIG. 4. The circuit in FIG. 4 outputs divided voltages VR1 and VR2 from between three resistors 1/G1, 1/G2, and 1/G3 which are connected in series. The values of the G1–G3 are set by means of the electric characteristics of the NMOS transistors M1–M6, and the first, second and third differential input voltage.

As described above, because the NMOS transistors M1–M6 in FIG. 3 performs the same operation as that of the circuit having three resistors connected in series, it is possible to output two type of the divided voltages without having resistors. Further, because it is possible to change the resistance divided ratio in accordance with the gate voltages of the NMOS transistors M1–M4, the circuit in the second embodiment can output an optional voltage between the first and second standard voltage VD and VS.

(Third embodiment)

A third embodiment comprises the same basic construction as that of the second embodiment. The feature of the third embodiment is to decrease the number of the operational amplifiers in order to simplify the circuit.

Figure 5:
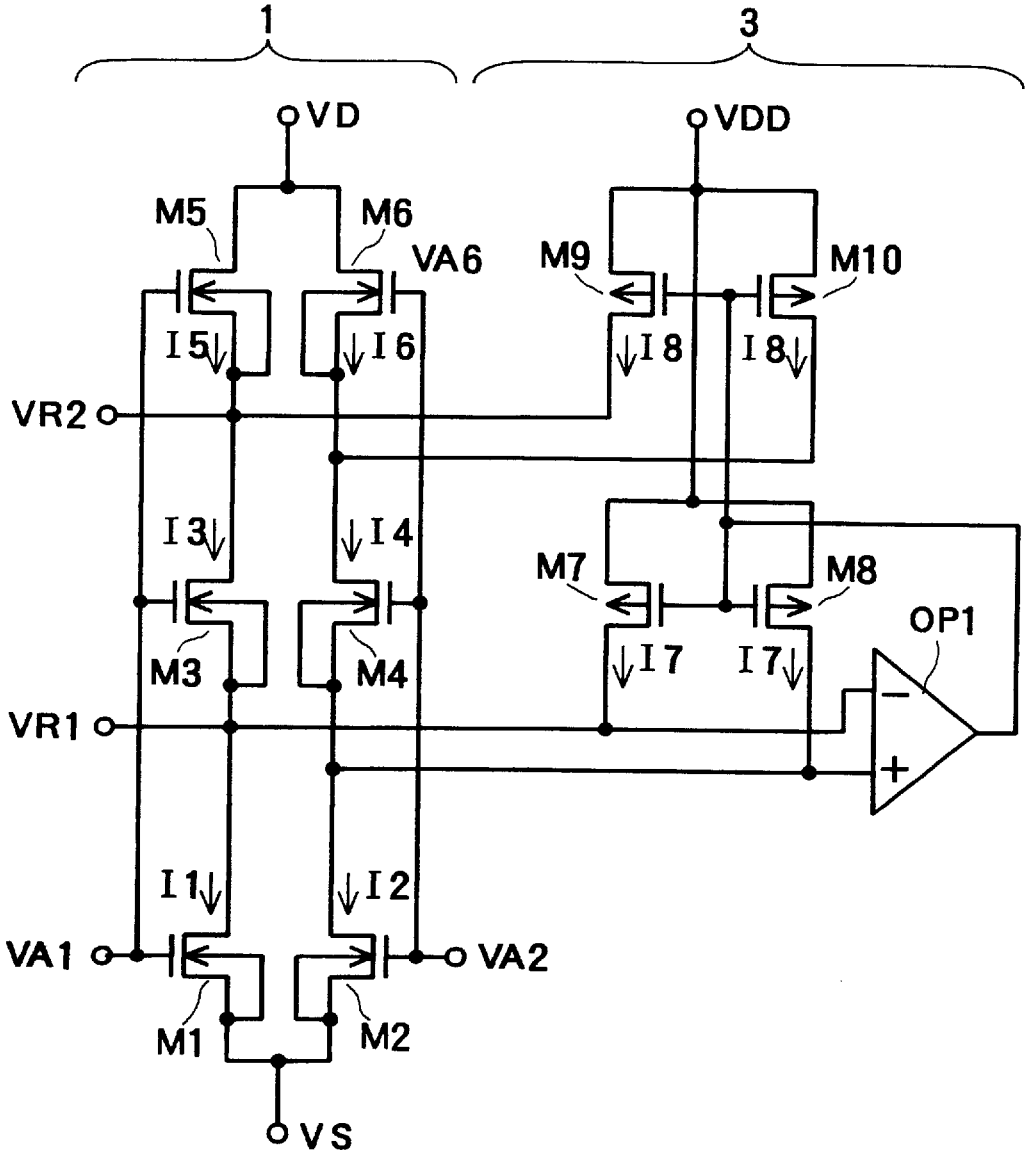
FIG. 5 is a circuit diagram showing the configuration of a voltage divider circuit in a third embodiment.

FIG. 5 is a circuit diagram showing the detailed configuration of a voltage divider circuit in the third embodiment. As shown in FIG. 5, the NMOS transistors M1–M6 have the source terminals connected to a substrate electrode. The NMOS transistors M1–M6 have almost the same electric characteristics. When equations (29)–(31) are established, equations (32)–(34) are obtained by the equations (25)–(27).

$$VA1=VA3=VA5 \tag{29}$$

$$VA2=VA4=VA6 \tag{30}$$

$$VA1>VA2 \tag{31}$$

$$G1=G2=G3 \tag{32}$$

$$VR1-VS=(VD-VS)/3 \tag{33}$$

$$VR2-VS=2(VD-VS)/3 \tag{34}$$

As described above, in the FIG. 5, when the equation (29)–(31) are established, the divided voltage VR1 and VR2 are consistent with a voltage equivalent to one third of a voltage between the first and second standard voltage. In this case, the current I7 flowing through the drain and source terminals of the NMOS transistors M7 and M8 is expressed by equation (35).

$$\begin{aligned} I7 &= I1-I3 \\ &= 2Kn*\{VA1-VS-Vthn-(VR2-VR1)/2\}*(VR1-VS) \\ &= 2Kn'*\{VA3-VR1-Vthn'-(VR2-VR1)/2\}*(VR2-VR1) \end{aligned} \tag{35}$$

Similarly, the current I8 flowing through the drain and source terminals of the NMOS transistors M9 and M10 is expressed by equation (36).

$$\begin{aligned} I8 &= I3-I5 \\ &= 2Kn'*\{VA3-VR1-Vthn'-(VR2-VR1)/2\}*(VR2-VR1)- \\ &\quad 2Kn''*\{VA5-VR2-Vthn''-(VR2-VR1)/2\}*(VD-VR2) \end{aligned} \tag{36}$$

In equations (35) and (36), Vthn is the threshold voltage of the NMOS transistors M1 and M2, Vthn' is the threshold voltage of the NMOS transistors M3 and M4, and Vthn" is the threshold voltage of the NMOS transistors M5 and M6.

In FIG. 5, because the same voltage VA1 is applied to the gate terminals of the NMOS transistors M1, M3 and M5, and the same voltage VA2 is applied to the gate terminals of the NMOS transistors M2, M4 and M6, equations (37) and (38) are established.

$$Kn=Kn'=Kn'' \tag{37}$$

$$VA1=VA3=VA5 \tag{38}$$

Equation (39) is obtained by the equations (33) and (34).

$$VD-VR2=VR2-VR1=VR1-VS \tag{39}$$

When the equations (37)–(39) are substituted for the equations (35) and (36), the following equations (40) and (41) are established.

$$I7=2Kn*\{(VR1-VS)-(Vthn-Vthn')\}*(VR1-VS) \tag{40}$$

$$I8=2Kn*\{(VR1-VS)-(Vthn'-Vthn'')\}*(VR1-VS) \tag{41}$$

Accordingly, the following equation (42) is obtained from the equations (40) and (41).

$$I7-I8=2Kn*\{(Vthn'-Vthn)-(Vthn''-Vthn')\}*(VR1-VS) \tag{42}$$

The equation (42) includes the threshold voltages Vthn, Vthn' and Vthn". When the voltage of the substrate electrode is equal to the source voltage, the influence of the body effect is avoided, and Vthn=Vthn'=Vthn" is established.

In this case, the right side of the equation (42) becomes zero; consequently, I7=I8 is established.

That is, because the circuit in FIG. 5 comprises the NMOS transistors M1–M6, the source terminals of which are connected to the substrate electrode, I7=I8 is established. Therefore, it is possible to control the gate voltage of the load transistor pairs M7–M10 by using only one of the operational amplifier.

As described above, because the third embodiment equalizes all the differential input voltage applied between the gate terminals, and connects the respective source terminals of the NMOS transistors M1–M6 to the substrate electrode, the current flowing through the drain and source terminals of the load transistor pairs M7–M10 becomes equal, and it becomes possible to share the operational amplifier. Further, because the divided voltage is set to the voltage divided the voltage between the first and second standard voltages VD and VS into three, the third embodiment is especially useful in case such a divided voltage is needed.

(Fourth embodiment)

A fourth embodiment is a variation of the third embodiment. N sets of transistor pairs are connected in series between the first and second standard voltages VD and VS.

Figure 6:
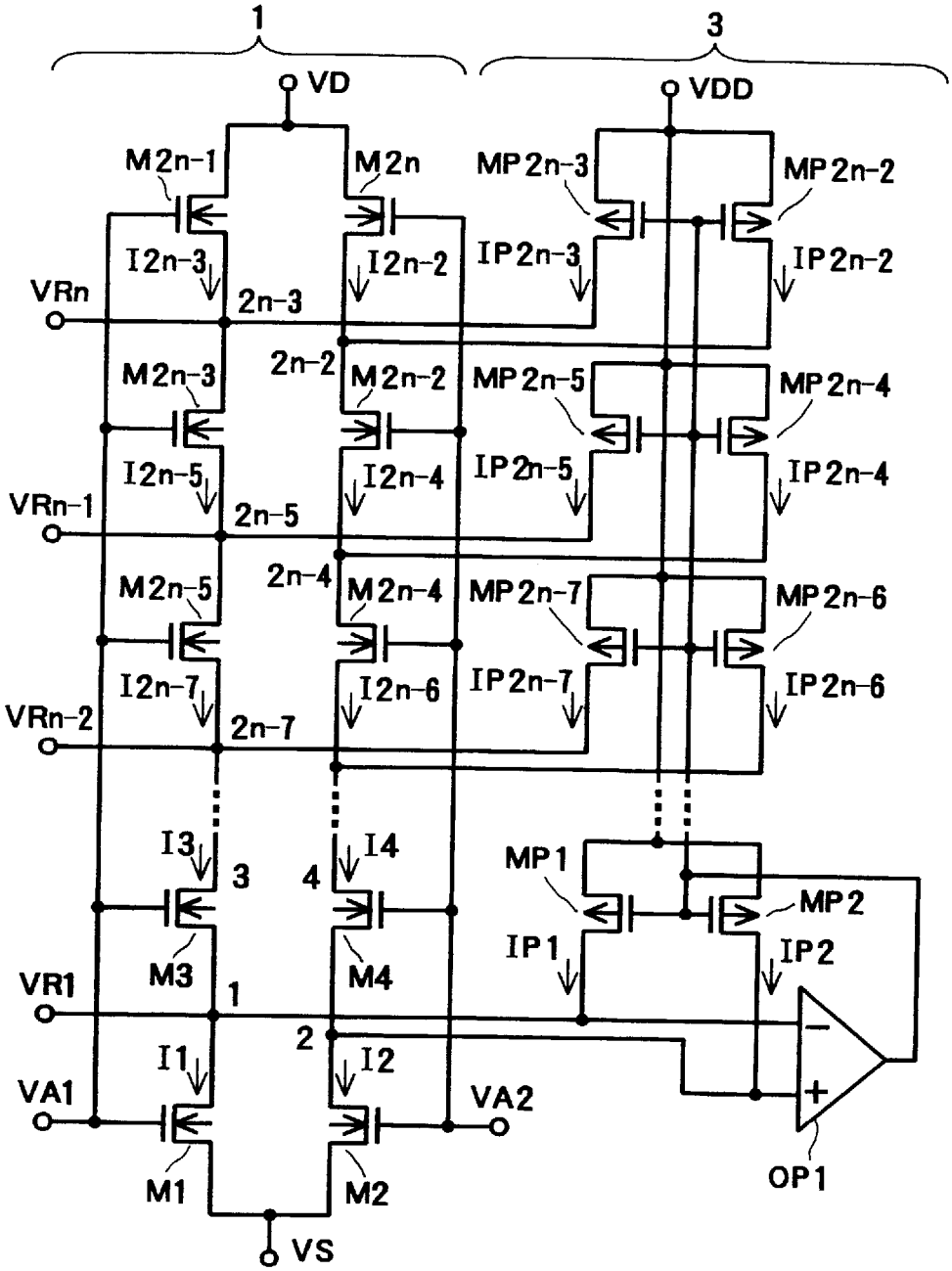
FIG. 6 is a circuit diagram showing the configuration of a voltage divider circuit in a fourth embodiment.

FIG. 6 is a circuit diagram showing the detailed configuration in the fourth embodiment. The voltage divider circuit in FIG. 6 comprises a plurality of transistor pairs 1 connected in series between the first and second standard voltage terminals VD and VS, and feedback control circuit 3. The NMOS transistors M1–M2n composing the transistor pairs 1 have the same electric characteristics. The same gate voltage VA1 is applied to the gate terminal of the NMOS transistors M1, M3, . . . , M2n−3. The same gate voltage VA2 is applied to the gate terminal of the NMOS transistors M2, M4, . . . , M2n−2. That is, the same differential input voltage (VA1−VA2) is applied between the gate terminals of the respective transistor pairs 1.

On the other hand, the feedback-control circuit 3 comprises (n−b 1) sets of the load transistor pairs 4 connected in series and an operational amplifier OP1. The PMOS transistors MP1–MP2n−2 composing the load transistor pair 4 have the same electric characteristics. The output terminal of the operational amplifier OP1 is connected to the gate terminal of each of the load transistor pairs 4, and the power supply voltage VDD is applied to the drain terminal. The output terminals of these load transistor pairs 4 are connected to the connection line connecting the respective transistor pairs arranged in adjacent location. The operational amplifier OP1 performs feedback-control so that the voltages of these connection lines become equal.

In the circuit in FIG. 6, the difference (IP2n−3–IP2n−2) of the current between the drain and source terminals of the load transistor pair 4 connected to the power supply voltage terminal VDD is expressed by equation (43).

$$IP2n-3-IP2n-2=2Kn*\{(Vthnn+1-Vthnn)-(Vthnn-Vthnn-1)*(VR1-VS) \tag{43}$$

The value of the Vthnn−1, Vthnn and Vthnn+1 come close to each other depending on the increase of the number of the transistor pairs connected in series. Therefore, when the number increases, the value of the left side of the equation (43) becomes small; consequently, the influence of the body effect is substantially avoided.

In the circuit in FIG. 6, the transistor pairs M1–M2n have the same electric characteristics as those of the load transistor pairs MP1–MP2n−2. Further, in the circuit in FIG. 6, the differential input voltages between the gate terminals of all the transistor pairs M1–M2n are set equal to each other, and the output voltage of the operational amplifier OP1 is applied to each gate terminal of all the load transistor pair 4. Furthermore, when the substrate electrodes of all the transistor pairs M1–M2n are connected to the P-well region in common, the following equation (44) is established; consequently, the divided voltage become a voltage equivalent to one Nth of the voltage between the first and second voltage VD and VS.

$$(V_{thnn+1}-V_{thnn})*(V_{thnn}-V_{thnn-1})\approx 0 \quad (44)$$

As described above, because the fourth embodiment connects the n sets of the transistor pairs having the same electric characteristics in series, and provides the load transistor pairs so that the voltage of the connection line connecting each of the transistor pairs arranged in adjacent location becomes equal, it is possible to output the divided voltage divided the voltage between the first and second standard voltage into n equal parts.

(Fifth embodiment)

A fifth embodiment comprises a differential amplifier circuit, which has a voltage divider circuit in FIG. 3.

Figure 7:
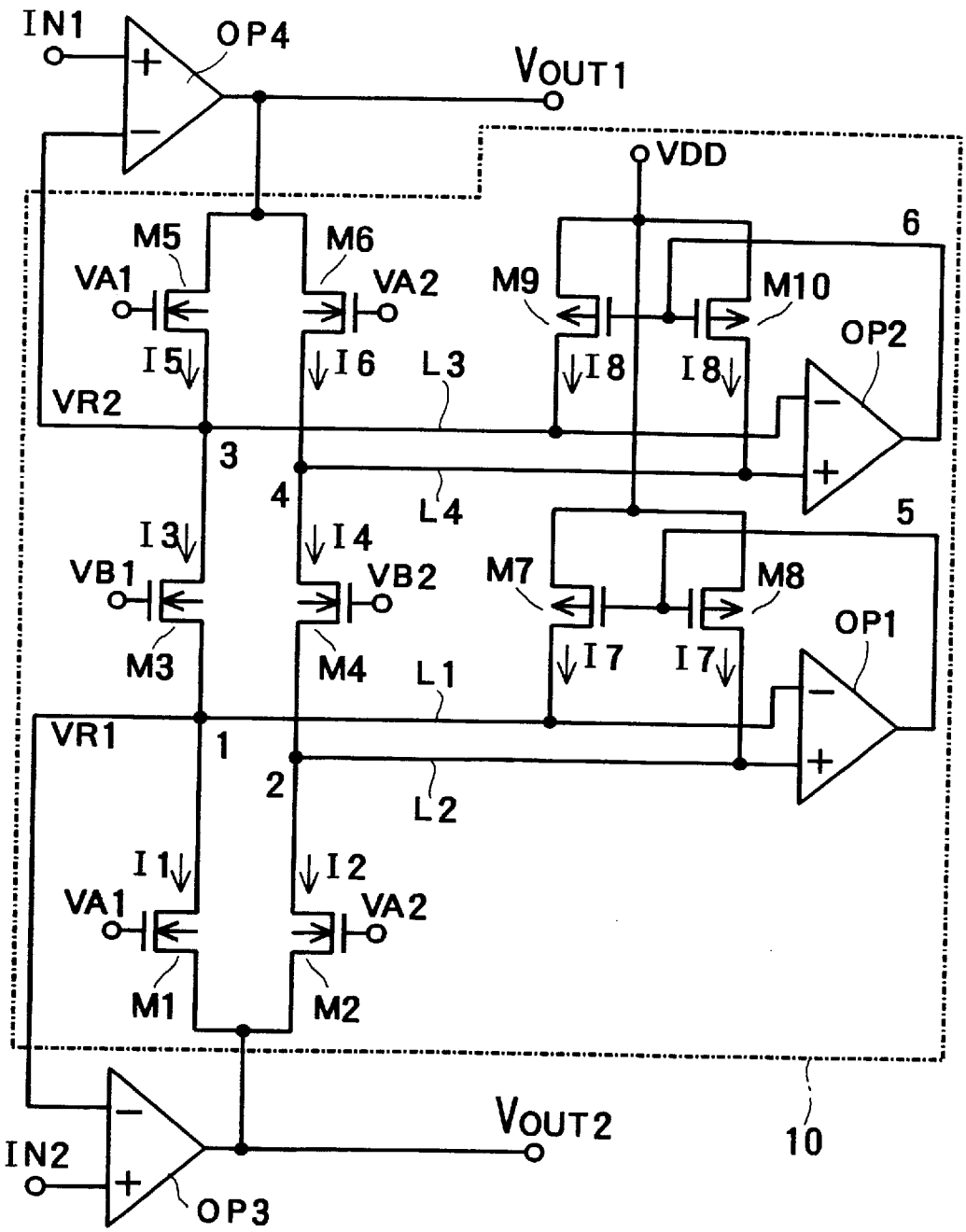
FIG. 7 is a circuit diagram showing the configuration of a differential amplifier.

FIG. 7 is a circuit diagram showing the detailed configuration in the fifth embodiment. A portion shown by a dot-and-dash line corresponds to a voltage divider 10, which has the same construction as that of the circuit in FIG. 3. The difference between the circuit in FIG. 7 and the circuit in FIG. 3 is that the circuit in FIG.3 applies the output voltages of the operational amplifiers OP3 and OP4 to both ends of the voltage divider 10 in FIG. 7.

Of two divided voltages VR1 and VR2 outputted from the voltage divider 10, one voltage VR1 is applied to the inverting input terminal of the operational amplifier OP3, and other voltage VR2 is applied to the non-inverting input terminal of the operational amplifier OP4. The second input voltage IN2 is applied to the non-inverting input terminal of the operational amplifier OP3, and the first input voltage IN1 is applied to the non-inverting input terminal of the operational amplifier OP4.

The circuit in FIG. 7 amplifies the first and second input voltages IN1 and IN2 depending on the resistance divided ratio using the operational amplifiers OP3 and OP4, and then outputs the amplified voltages.

With respect to the difference (VIN1–VIN2) of the first and second input voltages, the output VOUT1 of the operational amplifier OP3 and the output VOUT2 of the operational amplifier OP4, the following equation (45) is established.

$$(VOUT1-VOUT2)/(VIN1-VIN2)=(1/G2)^{-1}*(1/G1+1/G2+1/G3) \quad (45)$$

In case that the characteristics of the NMOS transistors M1, M2, MS and M6 are the same, the following equations (46) and (47) are established.

$$G1=G3=2Kn*(VA1-VA2) \quad (46)$$

$$G2=2Kn'*(VB1-VB2) \quad (47)$$

Figure 8:
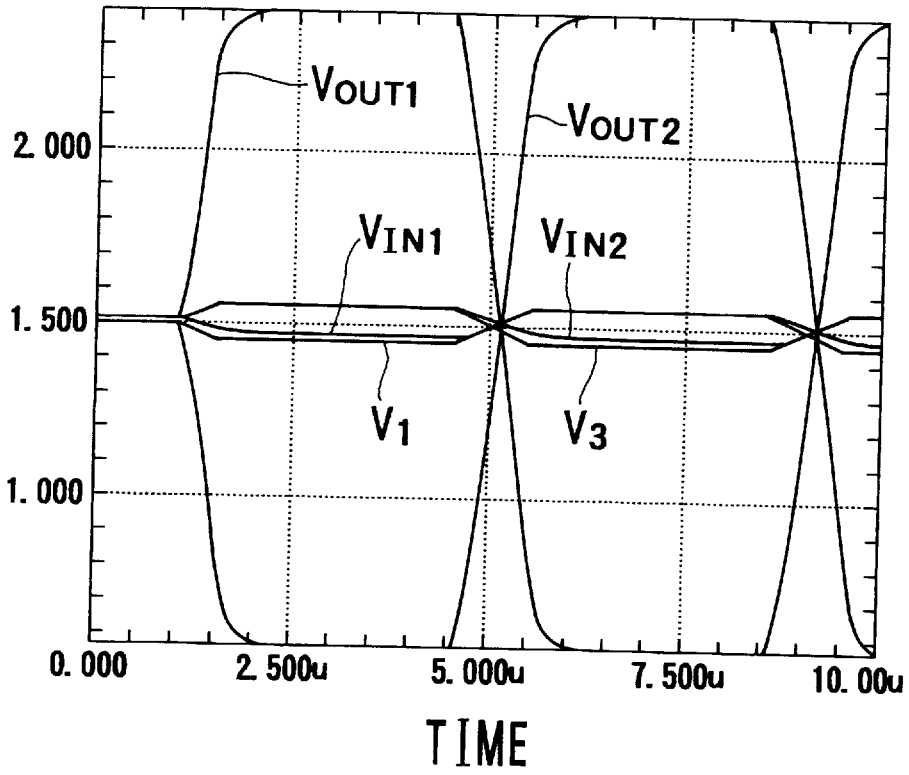
FIG. 8 is a diagram showing the results of the SPICE simulation in the circuit of FIG. 7.

FIG. 8 is a diagram illustrating results of SPICE simulation in the circuit of FIG. 7. A unit of a horizontal axis is time ($\mu$ sec), and a unit of a vertical axis is voltage (V). In the SPICE simulation in FIG. 8, the ratio of the Kn' of the equation (47) to the Kn of the equation (46) is set as the following equation (48).

$$Kn'/Kn=10 \quad (48)$$

When the equations (46)–(48) are substituted for the equation (45), the following equation (49) is established.

$$(VOUT1-VOUT2)/(VIN1-VIN2)=2(G2/G1)+1=2(Kn'/Kn)+1=21 \quad (49)$$

Further, a result that the amplification gain is about 20 has been obtained by the simulation of FIG. 8.

As described above, because the circuit in FIG. 7 comprises the differential output circuit having the voltage divider circuit constructed by the NMOS transistors, it is possible to integrate easily, and it is possible to optionally adjust the amplification gain by means of changing the gate voltage of the NMOS transistors. Further, when the electric characteristics of the NMOS transistors is the same, the differential output voltage is affected by the threshold voltage Vth, the mobility and so on; consequently, the high accurate differential output, which is not affected by the temperature and so on, is obtained.

In the fourth embodiment described above, in the same way as FIG. 5, the circuit can be simplified by decreasing the number of the operational amplifier.

In each embodiment described above, the examples, which comprise the transistor pairs constructed by the NMOS transistors and the load transistor pairs constructed by the PMOS transistors, have been described. However, it is possible to construct the transistor pairs using the PMOS transistors and the load transistor pairs using the NMOS transistors.

The circuit shown by each embodiment described above can be formed on a semiconductor substrate; otherwise the circuit can be constructed on a printed board using various parts. Further, in case the circuit according to the present invention is formed on a semiconductor substrate, the printed board and so on, the circuit other than a circuit according to the present invention may be formed together.

In each embodiment described above, the operational amplifiers are used. However, instead of the operational amplifiers, it is possible to use a differential amplifier circuit constructed by the MOS transistors and so on.

I claim:

1. A voltage divider circuit for outputting a divided voltage between first and second voltages, comprising:

a first voltage terminal with said first voltage;

a second voltage terminal with said second voltage;

a plurality of transistor pairs constructed by two MOS transistors, which have the same electric characteristics, said transistor pairs being connected in series between said first and second voltage terminals;

feedback control circuit for performing feedback-control so that voltages of connection lines which connect said each of transistor pairs arranged in adjacent location become equal, wherein said divided voltage is outputted from between said transistor pairs arranged in adjacent location.

2. The voltage divider circuit according to claim 1, voltage level of said divided voltage is controlled depending on voltage level of a differential input voltage inputted between gate terminals of the two MOS transistors composing each of said transistor pairs.

3. The voltage divider circuit according to claim 1, wherein:

the MOS transistors composing each of said transistor pairs are all of the same conduction type.

4. The voltage divider circuit according to claim 3, wherein:

the drain terminal of the MOS transistors arranged to one end of said transistor pairs connected in series is connected to said first voltage terminal;

the source terminal of the MOS transistors arranged to other end is connected to said second voltage terminal;

the drain terminals of the rest MOS transistors composing said transistor pairs are connected to the source terminal of the MOS transistors in adjacent location, respectively.

5. The voltage divider circuit according to claim 1, wherein feedback-control circuit further comprising:

at least one of load transistor pairs constructed by two MOS transistors which are provided in correspondence with each of first and second connection lines;

at least one of differential amplifier provided in correspondence with said each load transistor pair; wherein:

said each differential amplifier applies a voltage depending on the voltage difference between the corresponding first and second connection lines to gate terminals of said load transistor pairs;

said each load transistor pair controls the voltage of said first and second connection lines depending on the gate voltage.

6. The voltage divider circuit according to claim 1, wherein:

said feedback-control circuit further comprises:

at least one of load transistor pairs constructed by two MOS transistors provided in correspondence with each of said first and second connection lines;

at least one of differential amplifier for controlling the gate voltage of said load transistor pairs, wherein:

the same differential input voltage are applied between the gate terminals of two MOS transistors composing each of said transistor pairs, respectively;

said differential amplifier applies the same voltage to the gate terminals of all said load transistor pairs so that the same current flows through the drain and source terminals.

7. The voltage divider circuit according to claim 1, wherein the source terminal of at least one of the MOS transistors is electrically connected to the substrate electrode.

8. The voltage divider circuit according to claim 5, wherein:

all the MOS transistors composing each of said transistor pairs are of a first conduction type;

all the MOS transistors composing each of said load transistor pairs are of a second conduction type.

9. The voltage divider circuit according to claim 6, wherein:

all the MOS transistors composing each of said transistor pairs are of the first conduction type;

all the MOS transistors composing each of said load transistor pairs are of the second conduction type.

10. A semiconductor integrated circuit, which comprises the voltage divider circuit according to claim 1, and is formed on a semiconductor substrate.

11. A differential output circuit which outputs a differential voltage depending on the difference between first and second input voltages, comprising:

a first differential amplifier having a differential input terminal to which said first input voltage is applied;

a second differential amplifier having a differential input terminal to which said second input voltage is applied;

a voltage divider circuit having a plurality of transistor pairs, each of which comprises two transistors with the same electric characteristics, which are connected in series between output terminals of said first and second differential amplifiers, wherein:

said voltage divider circuit comprises a feedback control circuit which performs feedback-control so that voltages of connection lines which connect each of said transistor pairs arranged in adjacent location become equal, wherein one of two divided voltages outputted from said voltage divider circuit is applied to the other of the differential input terminals of said second differential amplifier;

the other of the divided voltages is applied to the other of the differential input terminals of said second differential amplifier; and said differential voltage is outputted from said first and second differential amplifiers.

12. The differential amplifier of claim 11, wherein:

the voltage level of said differential voltage which are outputted from said first and second differential amplifiers is controlled depending on the voltage level of a differential input voltage inputted between the gate terminals of said transistor pairs.

13. The differential amplifier of claim 11, wherein the MOS transistors composing said transistor pairs are all of the same conduction type.

14. The differential amplifier of claim 11, wherein:

the drain terminal of the MOS transistors arranged to one end of said transistor pairs connected in series is connected to said first voltage terminal;

the source terminal of the MOS transistors arranged to the other end of said transistor pairs connected in series is connected to said second voltage terminal;

the drain terminals of the rest MOS transistors composing said transistor pairs are connected to the source terminals of the MOS transistors in adjacent location.

15. The differential amplifier of claim 11, wherein feedback-control circuit comprises:

at least one of load transistor pairs constructed by two MOS transistors provided in correspondence with said each of first and second connection lines;

at least one of differential amplifier provided in correspondence with said load transistor pairs, respectively; wherein:

each of said differential amplifier applies a voltage depending on the difference between the voltages of said first and second connection lines to gate terminals of said load transistor pairs; and each of said load transistor pairs controls the voltage of said first and second connection lines depending on the gate voltage.

16. The differential amplifier of claim 11, wherein: said feedback-control circuit comprises:

at least one of load transistor pairs constructed by two MOS transistors provided in correspondence with said first and second connection lines;

at least one of differential amplifier for controlling the gate voltages of said load transistor pairs; wherein:

the same differential input voltage is applied between the gate terminals of two MOS transistors composing each of said transistor pairs, respectively;

said differential amplifier applies the same voltage to the gate terminals of all said load transistor pairs so that the same current flows through the drain and source terminals.

17. The differential amplifier according to claim 11, wherein the source terminal of at least one of the MOS transistors composing said transistor pairs is electrically connected to the substrate electrode.

18. The differential amplifier according to claim 15, wherein:

all the MOS transistors composing said transistor pairs are of a first conduction type;

all the MOS transistors composing said load transistor pairs are of a second conduction type.

19. The differential amplifier according to claim 16, wherein:

all the MOS transistors composing said transistor pairs are of a first conduction type;

all the MOS transistors composing said load transistor pairs are of a second conduction type.

20. A semiconductor integrated circuit, which comprises the voltage divider circuit according to claim 11, and is formed on a semiconductor substrate.

* * * * *